United States Patent [19]

Wilkes, Jr. et al.

[11] Patent Number: 4,991,667

[45] Date of Patent: Feb. 12, 1991

[54] HYDRAULIC DRILLING APPARATUS AND METHOD

[75] Inventors: Robert D. Wilkes, Jr.; Paul S. Turin; Michael J. Pesavento, all of Berkeley, Calif.; Ben W. O. Dickinson, III, 2125 Broderick St., San Francisco, Calif. 94115

[73] Assignees: Ben Wade Oakes Dickinson, III, San Francisco; Robert Wayne Dickinson, San Rafael, both of Calif.

[21] Appl. No.: 439,659

[22] Filed: Nov. 17, 1989

[51] Int. Cl.[5] ..... E21B 7/08; E21B 7/18

[52] U.S. Cl. ..... 175/61; 175/67; 175/424

[58] Field of Search ..... 175/61, 65, 67, 257, 175/424; 299/16, 17

[56] References Cited

U.S. PATENT DOCUMENTS

| | | | |
|---|---|---|---|
| 2,873,092 | 2/1959 | Dwyer | 175/61 |
| 3,211,244 | 10/1965 | Cordary | 175/61 |
| 3,576,222 | 4/1971 | Acheson et al. | 175/67 |
| 4,262,757 | 4/1981 | Johnson, Jr. et al. | 175/67 |
| 4,637,479 | 1/1987 | Leising | 175/26 |
| 4,787,465 | 11/1988 | Dickinson III et al. | 175/67 |
| 4,790,394 | 12/1988 | Dickinson III et al. | 175/61 |

*Primary Examiner*—Stephen J. Novosad

*Attorney, Agent, or Firm*—Flehr, Hohbach, Test, Albritton & Herbert

[57] ABSTRACT

Hydraulic drilling method and apparatus in which the drilling fluid itself is utilized to control the direction in which a hole is bored in the earth. The drilling fluid is discharged through a plurality of forwardly facing nozzles which are inclined at different angles about the axis of the drill head, and the drilling fluid is selectively applied to the nozzles by a rotatable valve member to control the direction in which the hole is cut.

13 Claims, 1 Drawing Sheet

HYDRAULIC DRILLING APPARATUS AND METHOD

This invention pertains generally to the drilling of boreholes in the earth, and more particularly to hydraulic drilling apparatus in which cutting is effected by streams of fluid directed against the material to be cut.

For many years, oil and gas wells have been drilled by a rotary bit mounted on a tubular drill string which extends down the borehole from the surface of the earth. The drill string is rotated at the surface, and the rotary motion is transmitted by the string to the bit at the bottom of the hole. A liquid commonly known as drilling mud is introduced through the drill string to carry cuttings produced by the bit to the surface through the annular space between the drill string and the wall of the borehole. This method of drilling has certain limitations and disadvantages. The string must be relatively heavy in order to transmit torque to the bit at the bottom of the hole. In hard rock, the drilling rate is slow, and the bit tends to wear rapidly. When the bit must be replaced or changed, the entire string must be pulled out of the hole and broken down into tubing joints as it is removed. It is necessary to use heavy, powerful machinery to handle the relatively heavy drill string. The string is relatively inflexible and difficult to negotiate around bends, and frictional contact between the string and the well casing or bore can produce wear as well as interfering with the rotation of the drill bit. Powerful equipment is also required in order to inject the drilling mud with sufficient pressure to remove cuttings from the bottom of the well.

More recently, wells and other boreholes have been drilled with small, high velocity streams or jets of fluid directed against the material to be cut. Examples of this technique are found in U.S. Pat. Nos. 4,431,069, 4,497,381, 4,501,337 and 4,527,639. In U.S. Pat. Nos. 4,431,069 and 4,501,337, the cutting jets are discharged from the distal end of a hollow pipe positioned within an eversible tube having a rollover area which is driven forward by pressurized fluid. U.S. Pat. Nos. 4,497,381 and 4,527,639 disclose hydraulic jet drill heads attached to drilling tubes which are driven forward by hydraulic pressure, with means for bending the tube to change the direction of drilling, e.g. from horizontal to vertical.

With some of the hydraulic drill heads heretofore provided, it is difficult to cut holes large enough to pass a drill string in certain materials. The larger diameter is important because the string must pass freely through the borehole for the system to operate properly. To produce a reasonably round and straight hole, the drill must cut in a symmetrical manner. In softer materials and unconsolidated formations, a non-rotating hydraulic drill head with axially directed jets may be able to cut holes several times the diameter of the drill head or spacing between the jets. However, in more indurated materials and consolidated formations, the hole cut by this drill head may not be much larger than the nozzles in the drill head itself. In some drill heads, obliquely inclined jets are employed to provide a desired cutting pattern. However, obliquely inclined jets tend to cut radial slots or grooves, rather than smooth round holes, and this problem increases as the oblique angle increases.

To produce larger holes, rotating drill heads with obliquely inclined jets have been provided. These jets may cut concentric grooves or slots and can produce holes larger than the drill head even in harder formations. Examples of such drill heads are found in U.S. Pat. Nos. 2,678,203, 3,055,442, 3,576,222, 4,031,971, 4,175,626 and 4,529,046. In most of these systems and in some non-rotating drill heads, abrasive particles are entrained in the cutting jets to improve the cutting action. U.S. Pat. No. 4,534,427 discloses a drill head which uses a combination of hydraulic jets and hard cutting edges to cut grooves and remove material between the grooves. While rotating drill heads are capable of cutting larger holes than non-rotating drill heads in certain materials, the useful life of rotating drill heads is severely limited by bearing wear, particularly when abrasive materials are present as in most drilling operations.

U.S. Pat. Nos. 3,528,704 and 3,713,699 disclose drill heads which employ cavitation of the drilling fluid in order to increase the erosive effect of the cutting jets. These drill heads appear to have the same limitations and disadvantages as other non-rotating drill heads as far as hole size is concerned, and they are limited in depth of application.

U.S. Pat. Nos. 4,787,465 and 4,790,394 disclose hydraulic drilling apparatus in which a whirling mass of pressurized drilling fluid is discharged through a nozzle as a high velocity cutting jet in the form of a thin conical shell. The direction of the borehole is controlled by controlling the discharge of the drilling fluid, either in side jets directed radially from the distal end portion of the drill string which carries the drill head or in a plurality of forwardly facing cutting jets aimed ahead of the drill string so as to modify the geometry of the hole being cut. This apparatus represents a substantial improvement over the hydraulic techniques which preceded it, and it cuts very effectively both in consolidated formations and in unconsolidated formations.

It is in general an object of the invention to provide a new and improved hydraulic drilling method and apparatus in which a portion of the drilling fluid is utilized to control the direction in which a hole is bored in the earth.

Another object of the invention is to provide a hydraulic drilling method and apparatus of the above character which overcomes the limitations and disadvantages of hydraulic drilling techniques of the prior art.

Another object of the invention is to provide a hydraulic drilling method and apparatus of the above character in which the drill head is economical to manufacture.

These and other objects are achieved in accordance with the invention by providing a hydraulic drilling method and apparatus in which the drilling fluid itself is utilized to control the direction in which a hole is bored in the earth. The drilling fluid is discharged through a plurality of forwardly facing nozzles which are inclined at different angles about the axis of the drill head, and the drilling fluid is selectively applied to the nozzles by a rotatable valve member to control the direction in which the hole is cut.

Figure 1:
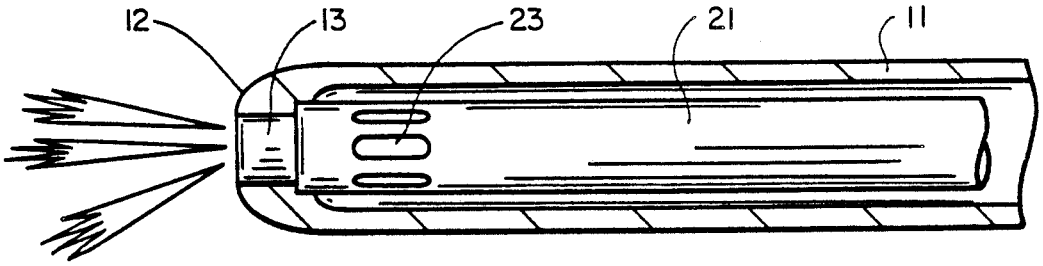
FIG. 1 is a centerline sectional view of one embodiment of drilling apparatus according to the invention.
Figure 2:
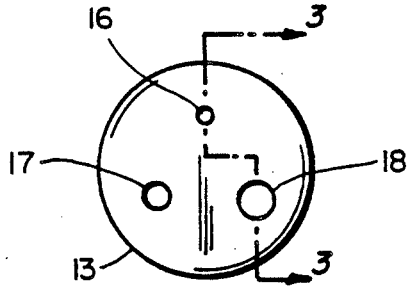
FIG. 2 is an end elevational view of the embodiment of FIG. 1.
Figure 3:
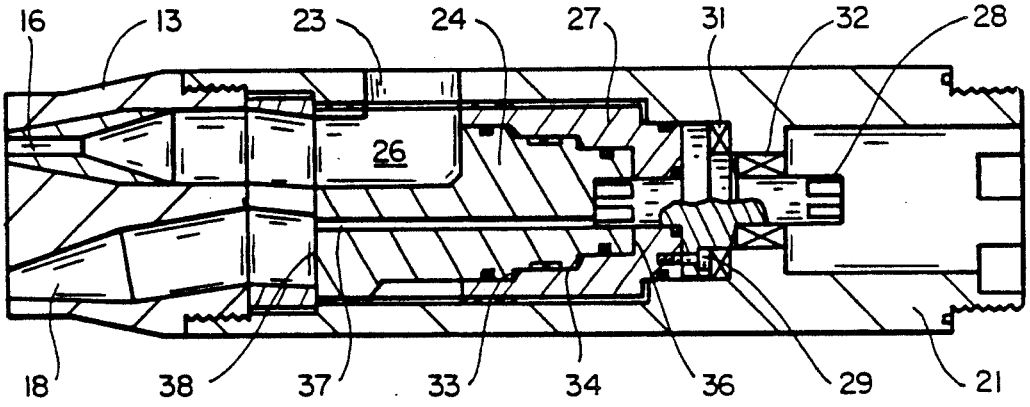
FIG. 3 is an enlarged, fragmentary sectional view taken along line 3—3 in FIG. 2.

As illustrated in FIG. 1, the drilling apparatus includes a tubular drill string 11 having a rounded nose or distal end 12 in which a drill head 13 is mounted. Pressurized drilling fluid is supplied to the drill head through the string and discharged in the form of high velocity cutting jets through a plurality of forwardly facing nozzles inclined at different angles relative to the axis of the drill string. Steering is effected by discharging the drilling fluid selectively through the nozzles to control the direction in which the hole is bored. In the particular embodiment illustrated, three nozzles 16–18 are provided, and they are inclined at angles on the order of 0°, 12° and 25°, respectively, relative to the longitudinal axis. It will be understood, however, that a greater or lesser number of nozzles can be employed, as can different angles of inclination.

The nozzles are formed in drill head 13 which is threadedly mounted in the front end of a housing 21. This housing is mounted in the distal end portion of drill string 11, and it can be removed and replaced without removing the drill string from a borehole. The drill head is thus part of a removable pod which can be readily changed, as needed.

Pressurized drilling fluid introduced into string 11 passes to the nozzles through a plurality of inlet openings or ports 23 in the side wall of housing 21. The inlet ends of nozzles 16–18 lie on a circle which is centered about the axis of housing 21, and the delivery of drilling fluid to the individual nozzles is controlled by a valve member 24. This valve member is mounted within the housing and can be rotated about the longitudinal axis of the housing. It has an eccentrically positioned bore 26 which can be selectively positioned in alignment with different of the nozzles upon rotation of the valve member. The bore can be provided with vanes (not shown) or other suitable means to induce a whirling motion in the pressurized fluid within the drill head so that it will be discharged in the form of a thin conical shell, as disclosed in U.S. Pat. Nos. 4,787,465 and 4,790,394. The rear portion of the valve member is received in a cup 27 which rotates with the valve member, and a drive shaft 28 is affixed to the cup by screws 29. The drive shaft is rotatively mounted in bearings 31, 32 carried by housing 21.

Means is provided for equalizing the pressure across valve member 24. In this regard, the rear portion of valve member 24 has two rearwardly facing shoulders or steps 33, 34 and a rear surface 36. Pressure equalizing passageways 37 extend longitudinally through the valve member from the front face 38 of the member. These passageways are positioned for alignment with the nozzles which are not aligned with bore 26. The pressurized drilling fluid is thus applied to forwardly and rearwardly facing surfaces of substantially equal area on the valve member to maintain a pressure equilibrium across the member.

It is apparent from the foregoing that a new and improved hydraulic drilling apparatus and method have been provided. While only certain presently preferred embodiments have been described in detail, as will be apparent to those familiar with the art, certain changes and modifications can be made without departing from the scope of the invention as defined by the following claims.

We claim:

1. In apparatus for drilling a borehole in the earth: a drill head having a plurality of forwardly facing nozzles inclined at different angles about an axis, a valve member rotatable about the axis and having a bore which can be brought into communication with different ones of the nozzles as the valve member is rotated, means for delivering a pressurized drilling fluid to the bore for discharge as a high velocity cutting jet through the nozzle in communication with the bore, and means for rotating the valve member to selectively position the bore in communication with different ones of the nozzles to control the direction in which the drilling fluid is discharged and the hole is cut.

2. The apparatus of claim 1 in which the nozzles are inclined at angles on the order of 0°, 12° and 25° relative to the axis.

3. The apparatus of claim 1 including means for applying the pressurized drilling fluid to forwardly and rearwardly facing surfaces of substantially equal area on the valve member to maintain a pressure equilibrium across the valve member.

4. The apparatus of claim 1 wherein the drill head and the valve member are part of a removable pod which is connected to a drill string and can be interchanged with other drill heads and valve members to produce cutting jets at different angles.

5. In apparatus for drilling a borehole in the earth: a drill string having a passageway for carrying a pressurized drilling fluid, a housing removably mounted on the drill string, a drill head mounted on the housing and having a plurality of forwardly facing nozzles inclined at different angles about the axis of the drill string, a valve member mounted within the housing for rotation about the axis and having a bore which can be brought into communication with different ones of the nozzles as the valve member is rotated, an orifice in the housing providing fluid communication between the passageway in the drill string and the bore in the valve member, said drilling fluid being discharged as a high velocity cutting jet through the nozzle in communication with the bore in the bore in the valve member, and means for rotating the valve member to selectively position the bore in communication with different ones of the nozzles to control the direction in which the drilling fluid is discharged and the hole is cut.

6. The apparatus of claim 5 in which the nozzles are inclined at angles on the order of 0°, 12° and 25° relative to the axis.

7. The apparatus of claim 5 including means for applying the pressurized drilling fluid to forwardly and rearwardly facing surfaces of substantially equal area on the valve member to maintain a pressure equilibrium across the valve member.

8. In apparatus for drilling a borehole in the earth: a source of pressurized drilling fluid, a drill head having a plurality of forwardly facing nozzles inclined at different angles about an axis through which the drilling fluid can be discharged in the form of high velocity cutting jets, valve means for controlling communication between the source and the nozzles, and means for actuating the valve means to provide communication between the source of pressurized fluid and selected ones of the nozzles to control the direction in which the drilling fluid is discharged and, hence, the direction in which the hole is cut.

9. In apparatus for drilling a borehole in the earth: a drill string having a passageway for carrying a pressurized drilling fluid, a housing removably mounted on the drill string, a drill head mounted on the housing and having a plurality of forwardly facing nozzles inclined at different angles about the axis of the drill string for discharging the pressurized drilling fluid in the form of high velocity cutting jets, valve means mounted within the housing for controlling communication between the nozzles and the passageway in the drill string, and means for actuating the valve means to selectively bring different ones of the nozzles into communication with the passageway to control the direction in which the drilling fluid is discharged and the hole is cut.

10. In a method of drilling a borehole in the earth, the steps of: introducing a drill head having a plurality of forwardly facing nozzles inclined at different angles about an axis into the borehole, supplying a pressurized drilling fluid to the drill head for discharge through the forwardly facing nozzles in the form of high velocity cutting jets, and selectively directing the pressurized drilling fluid to different ones of the nozzles to control the direction in which the fluid is discharged and the hole is cut.

11. The method of claim 10 wherein the drilling fluid is delivered to the nozzles through a bore in a valve member which is rotated to bring the bore into communication with different ones of the nozzles.

12. The method of claim 11 wherein the pressurized drilling fluid is applied to forwardly and rearwardly facing surfaces of substantially equal area on the valve member to maintain a pressure equilibrium across the valve member.

13. The method of claim 10 wherein the jets are discharged at angles on the order of 0°, 12° and 25° relative to the axis.

* * * * *